US007520095B2

(12) United States Patent
Platt et al.

(10) Patent No.: US 7,520,095 B2
(45) Date of Patent: Apr. 21, 2009

(54) HOOK CONNECTOR WITH PLASTIC FIRE RELIEF

(75) Inventors: William J. Platt, Aston, PA (US); Yu Lin, Blue Bell, PA (US)

(73) Assignee: Worthington Armstrong Venture, Malvern, PA (US)

( * ) Notice: Subject to any disclaimer, the term of this patent is extended or adjusted under 35 U.S.C. 154(b) by 520 days.

(21) Appl. No.: 11/130,529

(22) Filed: May 17, 2005

(65) Prior Publication Data

US 2006/0260244 A1 Nov. 23, 2006

(51) Int. Cl.
*E04B 9/08* (2006.01)
*E04C 2/02* (2006.01)

(52) U.S. Cl. ..... 52/232; 52/506.07; 52/573.1; 52/664; 52/DIG. 5

(58) Field of Classification Search ..... 52/1, 52/232, 317, 506.06, 506.07, 573.1, 664, 52/665, 667, 506.05, 509, DIG. 5; 403/347, 403/388

See application file for complete search history.

(56) References Cited

U.S. PATENT DOCUMENTS 3,119,475 A 1/1964 Adams
3,189,139 A 6/1965 Znamirowski et al.
3,390,503 A 7/1968 Emerick, Jr. et al.
3,396,997 A 8/1968 Adams
3,584,565 A * 6/1971 Bush ..... 454/303
3,589,089 A 6/1971 Kedel
3,708,932 A * 1/1973 Bailey et al. ..... 52/232
4,106,878 A 8/1978 Jones
4,128,978 A 12/1978 Beynon
4,545,166 A * 10/1985 Kielmeyer ..... 52/506.06
4,606,166 A 8/1986 Platt et al.
4,713,919 A 12/1987 Platt
4,827,681 A 5/1989 Platt
4,864,791 A 9/1989 Platt
4,893,444 A 1/1990 Ollinger et al.
4,955,134 A 9/1990 Platt
5,313,750 A 5/1994 Frecska et al.
5,347,783 A 9/1994 Frecska et al.
5,839,246 A 11/1998 Ziegler et al.
5,979,055 A 11/1999 Sauer et al.
6,138,416 A 10/2000 Platt
6,199,343 B1 3/2001 Sauer et al.
6,351,919 B1 3/2002 Lin et al.
6,523,313 B2 2/2003 Lin et al.

* cited by examiner

*Primary Examiner*—Richard E Chilcot, Jr.
*Assistant Examiner*—Bryan Eppes
(74) *Attorney, Agent, or Firm*—Eugene Chovanes

(57) ABSTRACT

The invention relates to a right-angle connection in the grid of a suspended ceiling, between inverted T-beams having a vertical web extending between a bulb at the top and flanges at the bottom. A connector on the end of a cross beam hooks into a slot in the web of a main beam. The connector has a plastic encasement that forms abutments about a metallic core. The abutments position the connector within the slot in the web, and prevent further entry of the connector into the slot, under normal conditions. The plastic abutments melt away during a fire, so that the beam can expand longitudinally into the slot to relieve stresses in the beam, without the beam buckling. Ridges on the bottom of the metallic core that engage the web at the bottom of the slot, prevent pullback of the connector from the slot, during a fire, to prevent the ceiling from sagging or drooping.

6 Claims, 6 Drawing Sheets

FIG.3
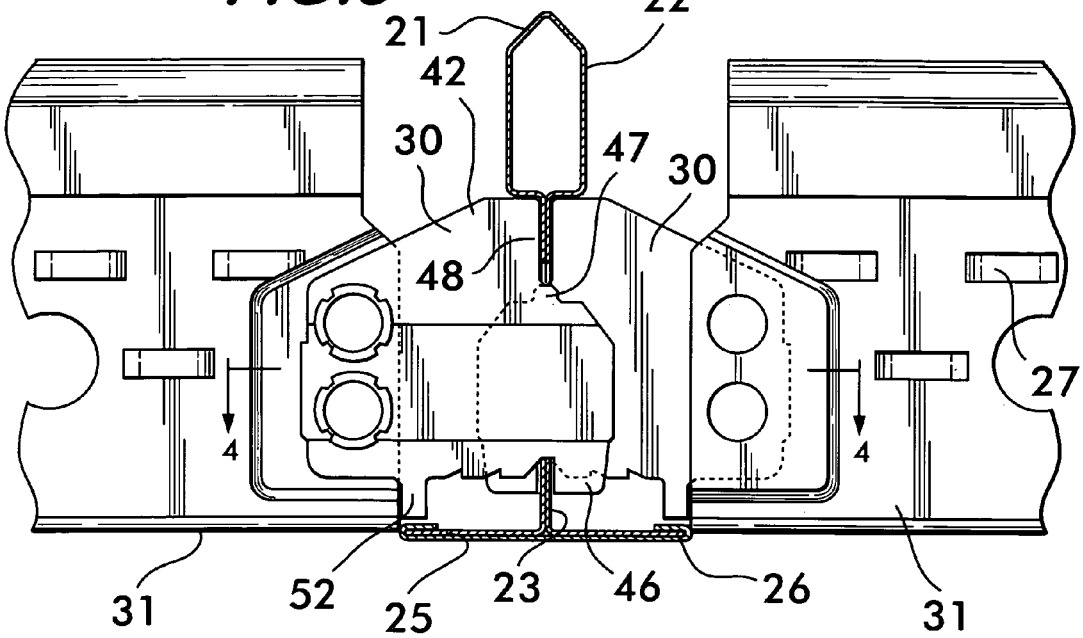
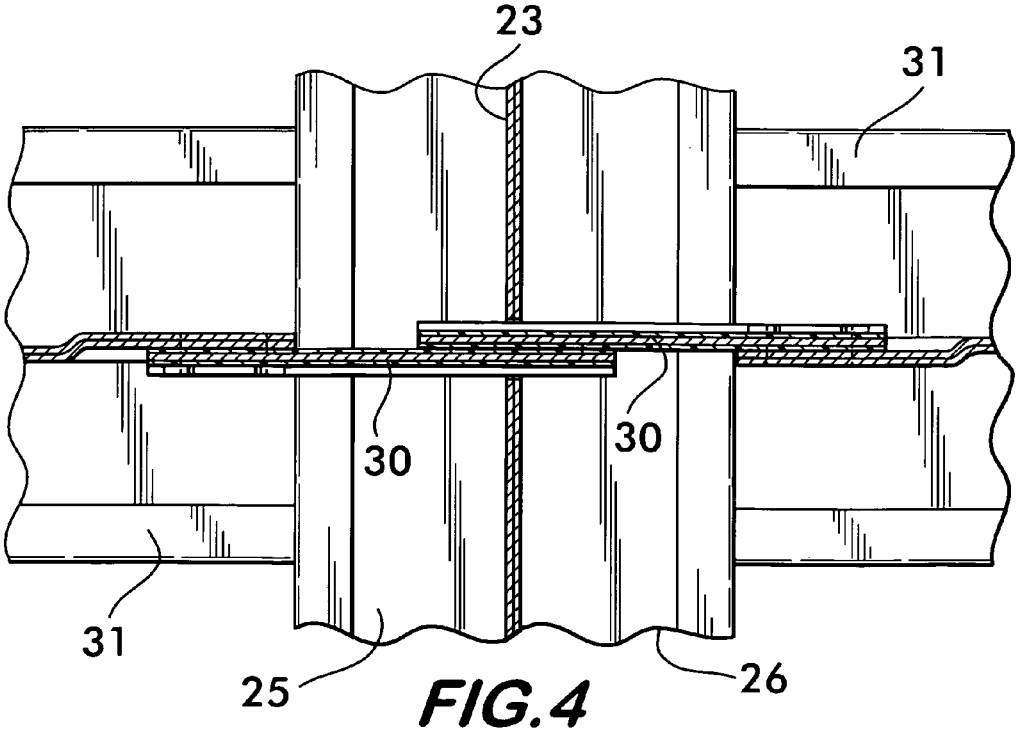
FIG.4

FIG.5
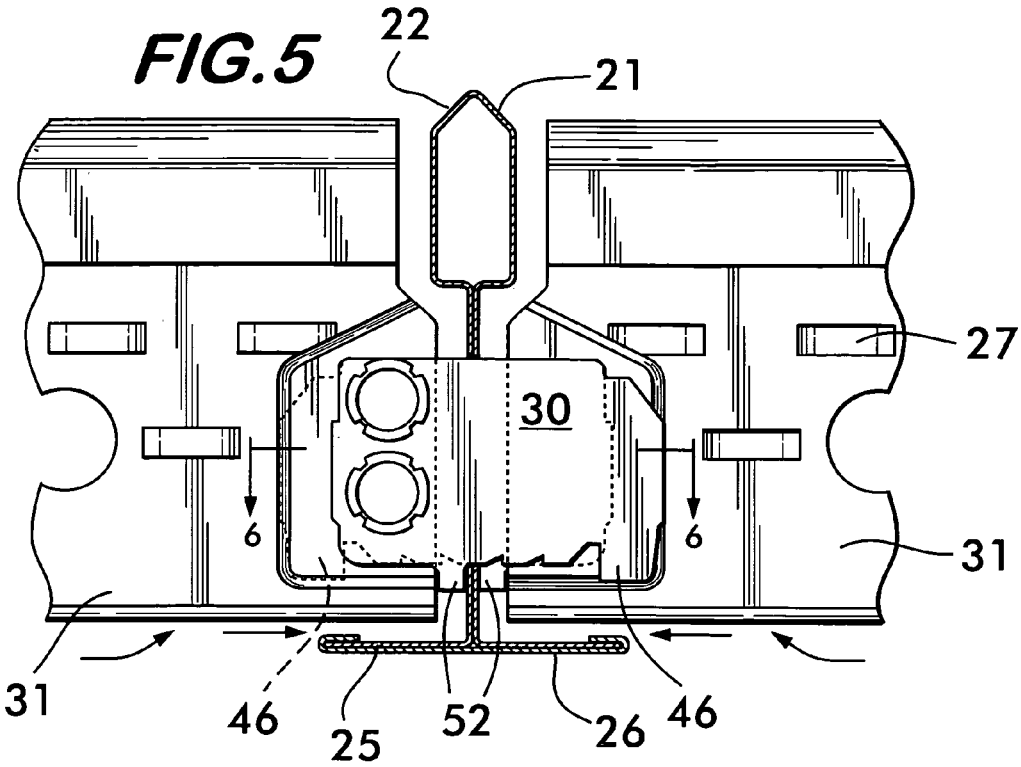
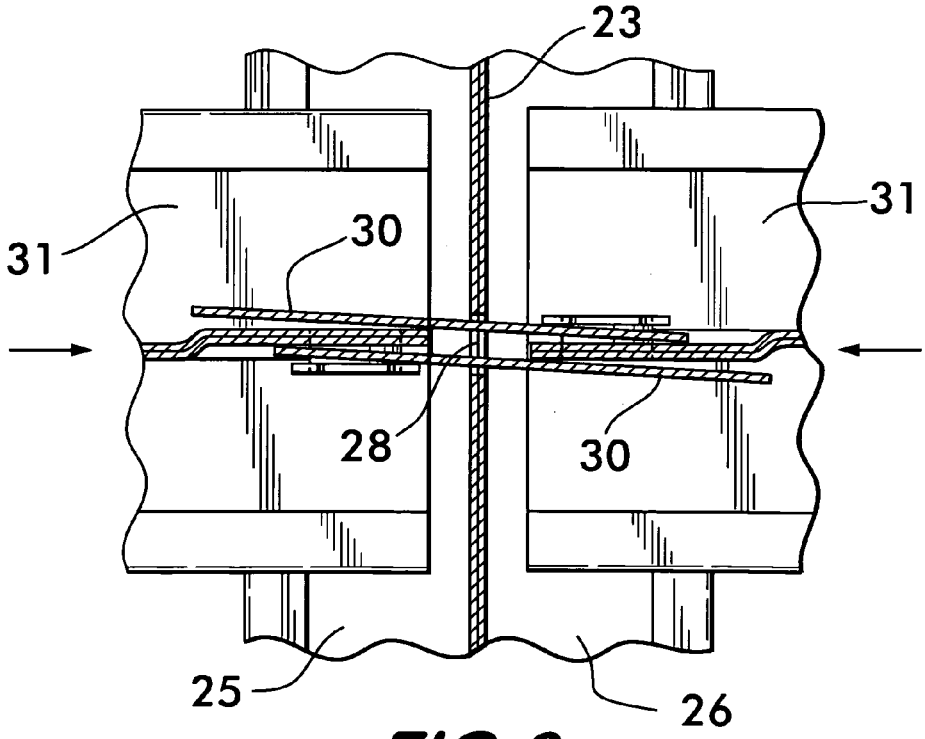
FIG.6

FIG. 7
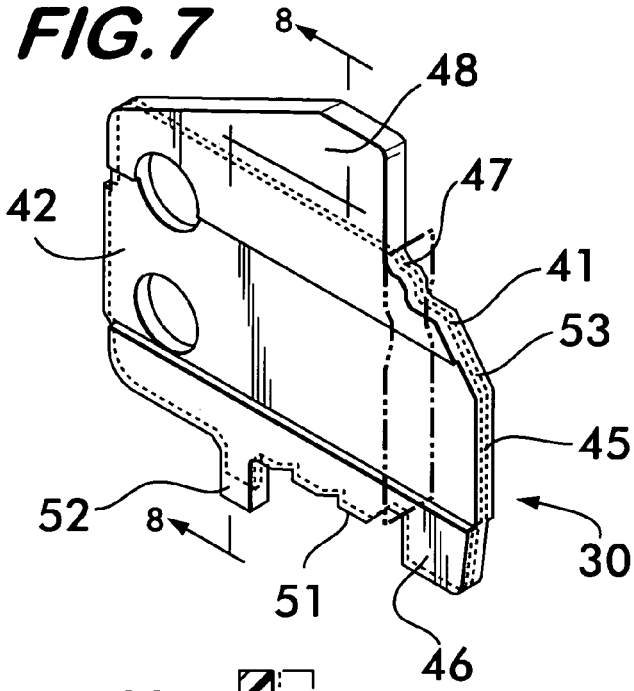
FIG. 9
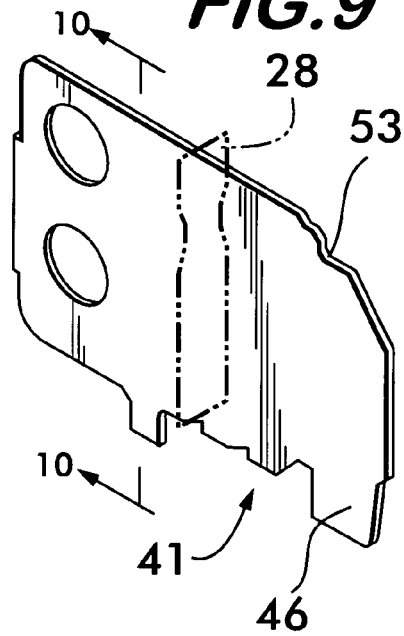
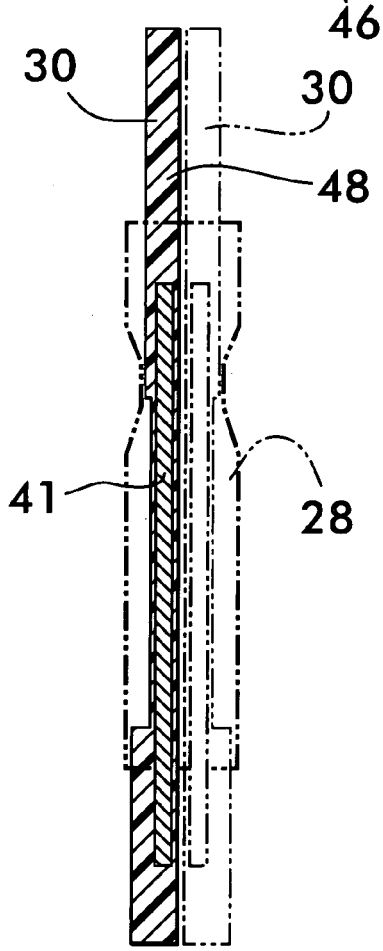
FIG. 8
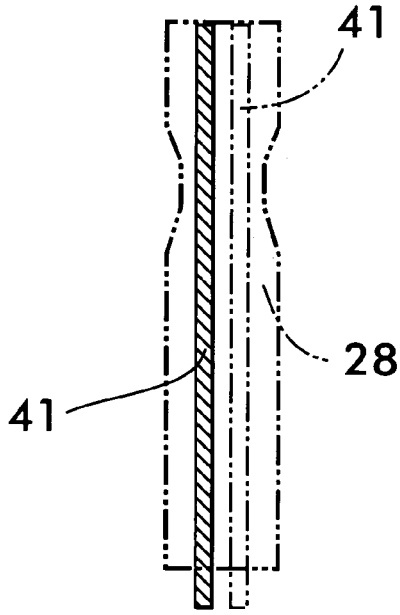
FIG. 10

HOOK CONNECTOR WITH PLASTIC FIRE RELIEF

BACKGROUND OF THE INVENTION (1) Field of the Invention

This invention relates to a metallic grid structure for a suspended ceiling, and more particularly to a connector in such structure that aids in keeping the ceiling intact, and without sagging from its own weight, during a fire.

(2) The Prior Art

A typical prior art suspended ceiling 10 is shown in FIG. 1 of the present drawings, wherein, in a grid 20, main beams 21 extend parallel to one another, at, for instance, 4' intervals. Cross beams 31 in the grid 20 span the distance between the main beams 21 and interlock with the main beams 21 through slots 28 in the main beams 21.

In the grid 20, main beams 21 are connected end to end in a variety of ways, including the one shown in U.S. Pat. No. 6,523,313, incorporated herein by reference. Cross beams generally are connected to the main beams through slots in the main beams 21, as for instance, by a hook in a connector, as shown, for instance, in U.S. Pat. No. 6,199,343, incorporated herein by reference. The present invention relates to a hook type connector.

The grid 20 is suspended from a structural ceiling by hang wires, and ceiling panels 33 are laid in the rectangular openings formed by the grid 20 and supported on the flanges of the beams 21 and 31 to form the suspended ceiling 10. The panels 33 are generally of a highly heat resistant type. The suspended ceiling 10 extends in a flat plane in its normal established position.

In the event of a fire, the metallic beams 21 and 31 seek to expand longitudinally from stresses created in the beams 21 and 31 by the elevated temperatures. Unless a beam is allowed to expand longitudinally to relieve the stresses, the beam will buckle, permitting a panel 33 to fall out of the opening, and allowing the heat of the fire to reach and destroy the structural ceiling. Thus, it is important to keep the suspended ceiling 10, with its highly heat resistant panels 33, intact, so that the suspended ceiling acts as a heat shield for the structural ceiling.

Additionally, during a fire, the suspended ceiling 10, including the beams and panels, tends to weaken from the heat of the fire, and sag or droop from the normally flat plane of the ceiling.

Such tendency to droop of, for instance, a cross beam, places a withdrawal or pullback force on the cross beam connector, notwithstanding that the cross beam must expand longitudinally to relieve the stresses induced by the heat of the fire to avoid buckling. Thus, it is also important to keep the ceiling from drooping or sagging to prevent the panels from dropping out of the grid, thus creating another condition, in addition to buckling beams, wherein the structural ceiling is exposed to the heat of the fire.

Once the fire subsides, the ceiling 10 is generally replaced, since even though the ceiling desirably survives the fire relatively intact to provide such heat shield to the structural ceiling, visually and structurally the ceiling is generally impaired.

Numerous means exist to permit the beams to expand longitudinally in a controlled manner so they continue to support the panels in the event of a fire. Such means for expansion are divided into those for main beams, and those for cross beams.

A representative main beam expansion means is shown, for instance, in U.S. Pat. No. 6,351,919, incorporated herein by reference. These expansion means consist essentially of cutouts along the beam that fold under compressive forces, while keeping the beam longitudinally aligned.

Representative cross beam expansion means are shown, for instance, in the '343 patent, and also in U.S. Pat. No. 5,839,246, incorporated herein by reference. Such expansion means consist essentially of tabs on the connectors on the ends of the cross beams, that break away and permit the connector to further enter into the slot, thus permitting the cross beam to stay longitudinally aligned to continue to support the panel.

SUMMARY OF THE PRESENT INVENTION

The present invention involves a connector on the end of a cross beam, in a grid in a suspended ceiling. The connector, which engages a slot in a main beam, is capable of permitting, in a fire, the cross beam to expand longitudinally and stay aligned to continue to support a panel, while keeping the cross beams from sagging or drooping.

The connector is of a hook type, wherein a connector on the end of a cross beam, with a hook in the connector, passes through a slot in the main beam, and hooks onto the main beam. Generally, in the grid, a connector on the end of each of two opposing beams enters a slot in a main beam. Such a connector is particularly shown in the above '343 and '246 patents.

In the present improvement, the connector is formed with an inner metallic core having a certain configuration, and a plastic encasement of the configured metallic core, having a configuration with added abutments to the metallic core. These abutments formed by the plastic encasement help position the connector within the slot, and particularly, bar further entry of the connector into the slot, under normal conditions.

In the event of a fire, the plastic encasement that forms the abutments melts away, permitting the connector to enter further into the slot, without interference from the inner metallic core, to allow the cross beam to expand longitudinally while continuing to support a ceiling panel, with its fire resistant qualities, without the cross beam buckling.

The remaining inner metallic core of the connector, which remains structurally sound during a fire, continues to support the connector within the slot, so that the cross beam, in its expanded state, is still supported by the main beam. The metallic core also has ridges that are capable of successively engaging the main beam slot to prevent pullback of the connector during a fire, so that the ceiling does not sag or droop.

A number of connectors can be made at one time by first extruding plastic wherein the extruded plastic has a rectangular cross section, about a metallic strip, that is also rectangular in cross section, though smaller than that of the plastic cross section, to encase the metal strip within the plastic. The plastic encased metallic strip is then stamped into a number of connectors attached to one another, and then cut into individual connectors that are attached to a cross beam end, as by riveting or peening.

BRIEF DESCRIPTION OF THE DRAWINGS

FIG. 3 is a partial side elevational view of the connection of the invention in normal condition, before a fire.

FIG. 4 is a sectional view taken on the line 4-4 of FIG. 3.

FIG. 5 is a partial side elevational view, similar to FIG. 3, showing the connection of the invention after a fire, with the plastic encasement melted away.

FIG. 6 is a sectional view taken on line 6-6 of FIG. 5.

FIG. 7 is a perspective view showing the connector of the invention in a normal condition.

FIG. 8 is a sectional view taken on line 8-8 of FIG. 7, with the connector and an opposing connector extending within a slot, with the opposing connector and slot shown in phantom.

FIG. 9 is a perspective view similar to FIG. 7 showing the connector after a fire with the plastic encasement melted away.

FIG. 10 is a sectional view taken on line 10-10 of FIG. 9, with the metallic core of the connector and the metallic core of an opposing connector extending within a slot, with both the opposing metallic core and the slot shown in phantom.

DESCRIPTION OF THE PREFERRED EMBODIMENT

Figure 1:
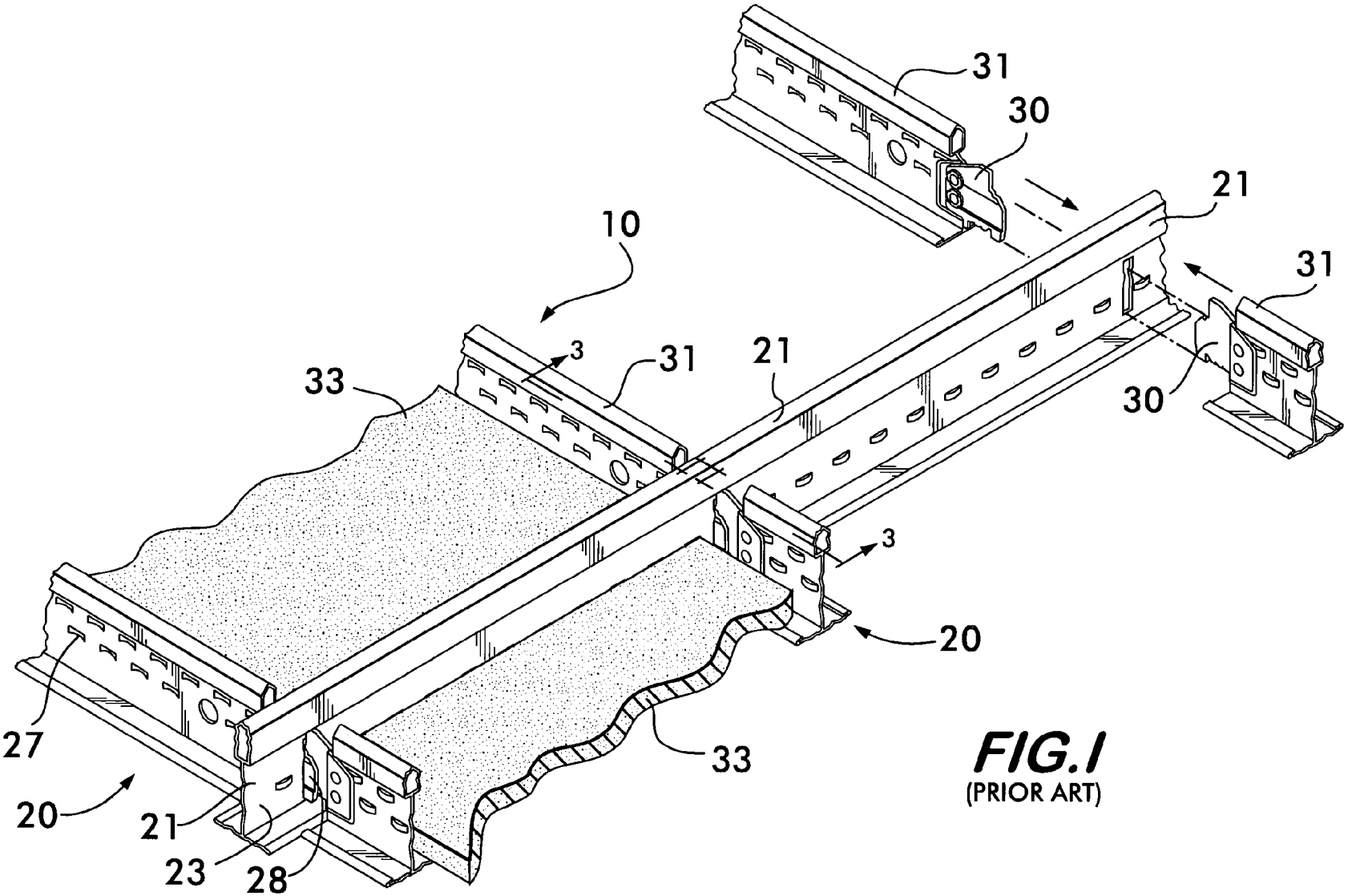
FIG. 1 (PRIOR ART)
FIG. 1 is a fragmentary perspective view of the suspended ceiling showing, in one section, the ceiling assembled, with, on the left, the cross beam connectors of the invention assembled to the main beam through a slot, with a ceiling panel in place, and in another section, on the right, a pair of cross beams with the connectors of the invention at the ends of the beams being assembled into the main beam through a slot.
Figure 2:
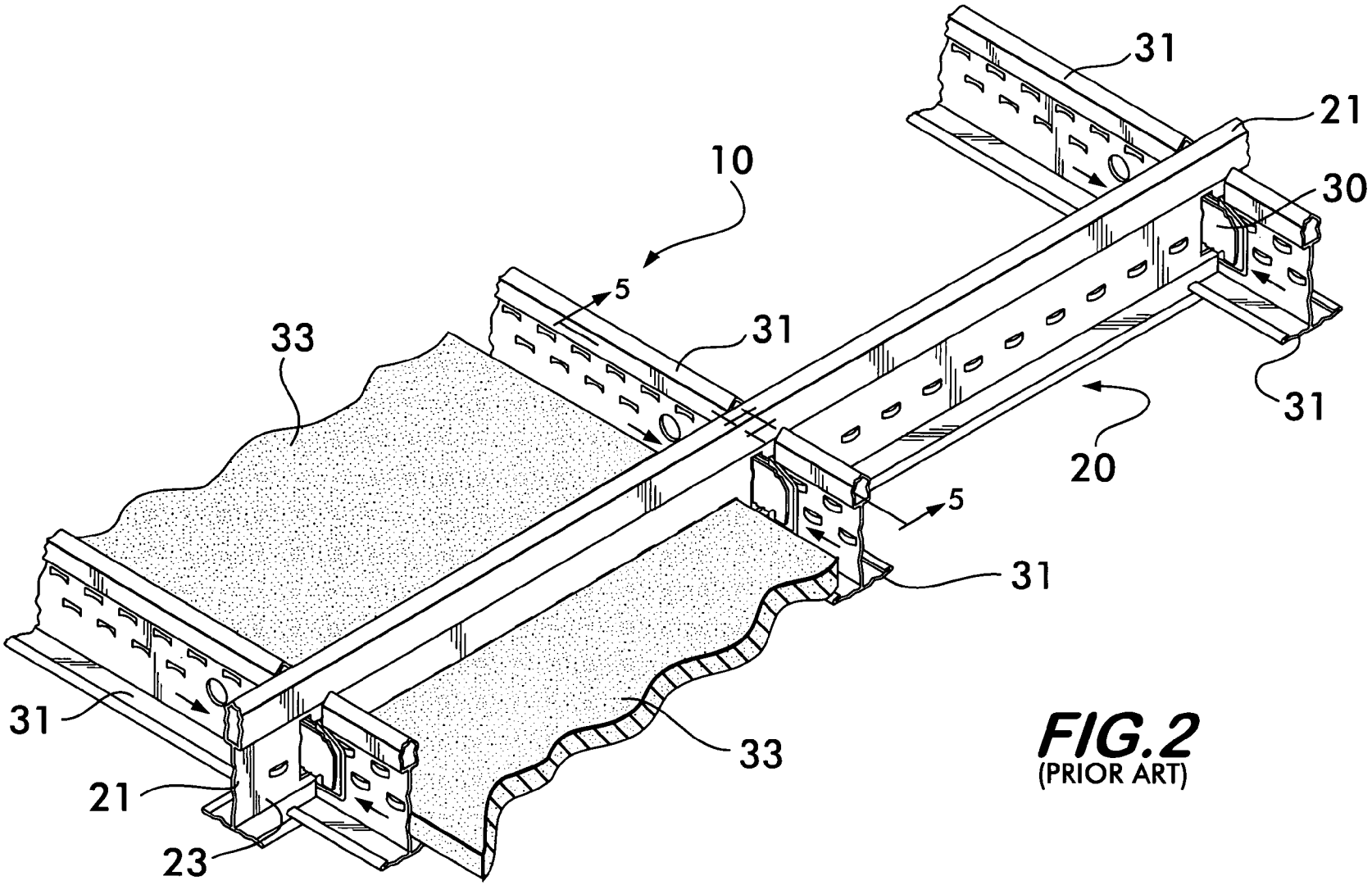
FIG.2 (PRIOR ART)
FIG. 2 is a perspective view similar to FIG. 1 showing an assembled suspended ceiling, with the cross beams having the connectors of the invention mounted thereon, assembled with the main beam, through a slot.

In FIG. 1, there is shown a grid 20 in a suspended ceiling 10, partially assembled, using the present invention. Main beam 21 is of an inverted T cross section and has a bulb 22, a web 23, and opposing flanges 25 and 26. The web 23 has stitches 27 that strengthen the beam 21. Such beam construction is well known and is of the type shown, for instance, in U.S. Pat. No. 6,138,416, incorporated herein by reference. The stitches 27 are of a type shown, for instance, in U.S. Pat. No. 5,979,055, incorporated herein by reference.

The suspended ceiling 10 is formed of a metallic grid 20 that supports ceiling panels 33 formed of a fire resistant substance, as well known in the art. Grid 20 has, in the main beams 21, slots 28 spaced longitudinally along webs 23 that receive connectors 30 on the end of cross beams 31.

The connectors 30 on cross beams 31 are secured on the ends of the cross beams 31 by riveting or peening, as for instance seen in the '343 patent.

Opposing connectors 30 are hooked through a slot 28 in the main beam 21, at right angles thereto, in the grid 20, again as seen for instance in the '343 patent.

The intersecting beams 21 and 31 in the grid 20 form rectangular openings that support the panels 33 on the flanges 25 and 26 of the beams.

The entire suspended ceiling 10 is supported from a structural ceiling by hang wires that pass through holes in the main beams 21, and that are embedded in the structural ceiling, all in the prior art manner.

As seen particularly in FIGS. 7 through 10, the present connector 30 is formed of an inner metallic core 41 with an outer plastic encasement 42 formed over the metallic core 41.

The present connector, designated 30 in the drawings, has a profile that includes a forward portion 45 that engages slot 28, as seen particularly in FIG. 3. Forward portion 45 has a lower segment that serves as a hook 46 that prevents withdrawal of the connector 30 once the connector 30 is engaged in the slot 28, under normal conditions. Connectors with such hooks are well known in the prior art.

An abutment 47 on the upper part of the forward portion 45 keeps the connector 30 secured vertically downward in the slot 28. An uppermost segment of the connector 30 acts as an abutment 48 to bar the connector 30 from further entry into the slot 28 under normal conditions. Abutment 48 also engages the underside of bulb 22 as seen in FIG. 3, in addition to abutment 47 which engages the top of slot 28, to keep the connector 30 secured downward in the slot 28 to keep hook 46 engaged with the web 23 to prevent withdrawal.

At the lower end of the connector 30 there are a series of ridges 51, the forwardmost of which also serves to keep the connector 30 positioned within the slot 28.

A rearward stop 52 extends downward at the bottom of the connector 30. This stop 52 keeps the connector in position above flange 25 or 26 while the connector is being hooked into slot 28, by riding on top of such flange, and particularly along the hem of such flange. There is shown in FIG. 3 a stop 52 positioned above the hem on each of flanges 25 and 26, when the connectors are engaged.

A sloping portion 53 permits the hook 46 to be engaged in the slot 28 without interference from web 23.

The present improved connector 30 has a profile as described above, and as shown in FIGS. 7 through 10.

In the present improved connector 30, a plastic encasement 42, of for instance PVC or ABS, encases a metallic core 41. The plastic encasement 42 forms the profile described above, as seen in the drawings.

The profile of the metallic core 41 is the same as the plastic encasement 42, except the metallic core 41 does not have the upper forward abutment portion 48.

The connectors 30 are engaged from opposite sides, as seen in FIG. 1, by a hooking action into the position shown in FIG. 3, as set forth for instance, in the '343 patent. In such hooked position, hook 46 keeps the connector 30 from being pulled back out of slot 28. Further entry into the slot 28 is barred by abutment 48 which, as set forth above, is formed of plastic.

With the connector 30 as shown in FIGS. 3 and 4, the cross beams 31 are locked to the main beams 21 in the ceiling grid 20, to, under normal conditions, form an intact grid 20, that supports panels 33 in the suspended ceiling 10.

In the event of a fire, it is highly desirable, as well known in the prior art, to keep the suspended ceiling 10, including grid 20 and panels 33 in place, to act as a shield that bars the heat of the fire from reaching the structural ceiling. During such a fire that heats up the grid 20 in suspended ceiling 10, expansion forces are created in the grid beams 21 and 31 of the suspended ceiling 10.

Stresses that build up in the main beams 21 are relieved, for instance, by the prior art means set forth above.

Stresses from the fire that are also built up in the cross beams 31 are relieved by the improvement in the cross connectors 30 of the present invention. The connectors 30 of the present invention permit the cross beams 31 to expand longitudinally, by allowing the connectors 30 to further enter the slots 28 of main beams 21, and relieve such heat induced stresses in the cross beams 31. The heat of the fire melts away the plastic encasement 42 from the connector 30, reducing the connector 30 to its inner metallic core 41, as shown in FIGS. 9 and 10. In this condition, the plastic abutment 48 no longer exists, so there is no longer a barrier to further entry of the connector 30 into the slot 28, so that the cross beam 31 is permitted to expand longitudinally, and relieve the built up stresses from the heat of the fire, while keeping a panel 33 supported.

Ridges 51 prevent the beam 30 from pulling back during a fire, after the further entry of the connector 30 into the slot 28 to relieve expansion stresses, as set forth above. The particular ridge 51 that will prevent pullback at any given time during the fire depends on how far the connector 30 has entered into slot 28. By preventing pullback during a fire, the cross beams are kept taut so that the softened beams, and the heat softened panels supported by the beams, do not sag or droop.

When the ceiling 10 is being assembled, under normal conditions, rearward stop 52 serves as a leg that engages the flange of the main beam 21, and particularly the hem of the flange, to prevent the cross beam 31 from dropping below the main beam 21, whereby the connector 30 could not be engaged into slot 28 of the main beam.

Figure 11:
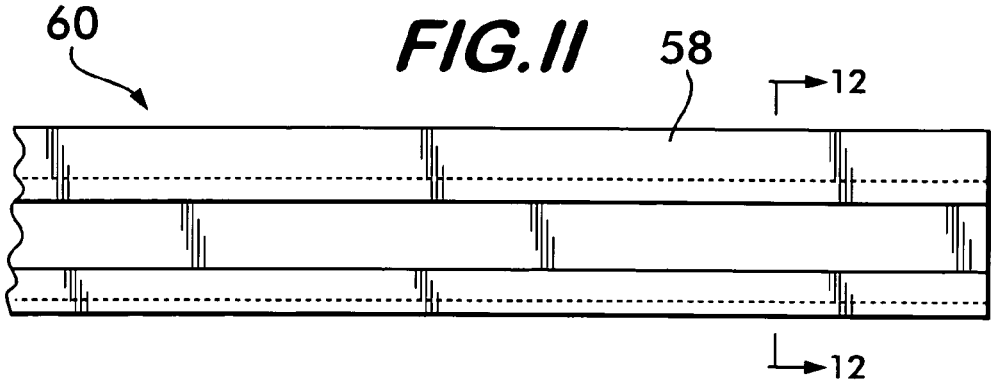
FIG. 11 is a side view of an extruded strip with plastic extruded over, and encasing, a metallic strip, both having a rectangular cross section.
Figure 12:
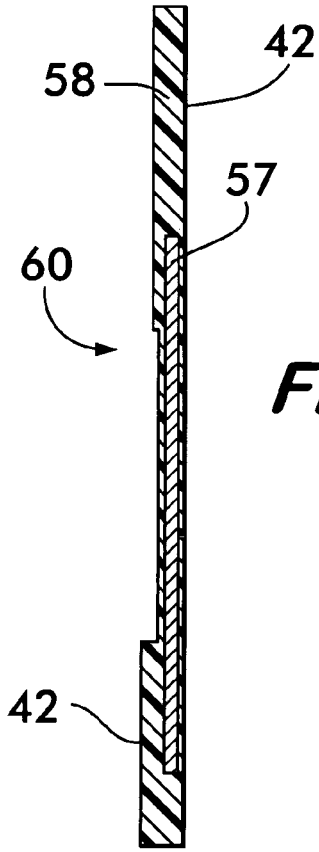
FIG. 12 is a cross section taken on the line 12-12 of FIG. 11.
Figure 13:
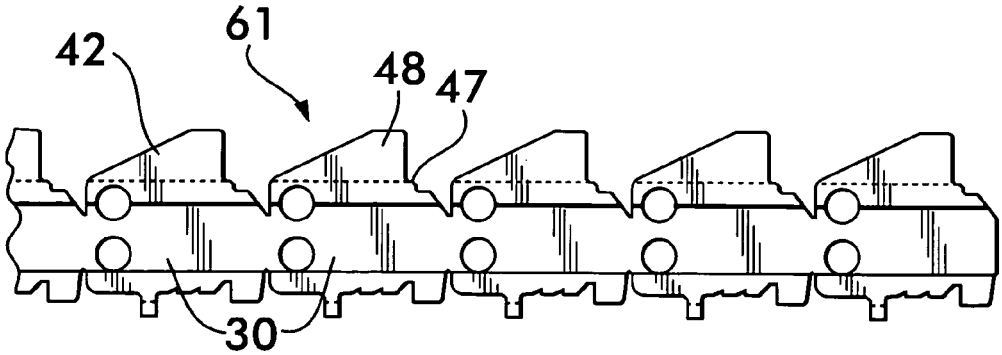
FIG. 13 is a side elevational view of the strip of FIGS. 11 and 12, after being stamped into individual connectors attached to one another.

The connectors 30 of the invention are suitably made, by continuously extruding plastic 58, rectangular in cross section, that will form abutment 48, about a metal strip 57, suitably steel, that will form the inner metallic core 41 of the finished connector 30. The metal strip 57 is also rectangular in cross sections, though of shorter height, as seen in FIGS. 11 and 12. The extruded plastic 58 about the strip forms a blank 60, which is then stamped into the form 61 shown in FIG. 12, with a plurality of connectors 30 attached to one another, formed from the blank 60. The stamped blank 61 is then severed into individual connectors 30 and attached to the cross beam 31 ends in the conventional prior art manner as by riveting or peening.

What is claimed is:

1. In a connection between a main beam and a cross beam for a grid in a suspended ceiling, wherein (1) the cross beam extends perpendicularly to the main beam, (2) both beams have an inverted T cross section with a web extending between a bulb at the top, and flanges at the bottom, (3) the web of the main beam has a vertically extending slot, (4) the cross beam has a connector that extends into the vertically extending slot, and has a hook that connects on the web of the main beam and prevents the connector from being withdrawn from the slot, the improvement comprising the connector having (a) a metal core that forms the hook, and (b) a plastic encasement over the metal core that forms abutments that position the connector within the slot and that bar further entry of the connector into the slot, wherein, during a fire, the plastic encasement is capable of melting away, so that the connector is capable of further entry into the slot to relieve expansion stresses built up in the cross beam from the heat of the fire.

2. The improvement of claim 1 wherein the cross beam has a web reinforced with stitches in the web.

3. The improvement of claim 1 wherein the metal core has ridges at the bottom thereof that prevent pullback of the connector from the slot, when the cross beam has expanded into the slot, during a fire, so that the ceiling does not droop during a fire.

4. The improvement of claim 1 wherein the metal core has a stop at the bottom capable of supporting the connector on the upper side of a flange of a main beam while the connector is being engaged into a slot on the main beam.

5. The improvement of claim 1 wherein the connector is formed by first extruding a plastic encasement about a metallic strip, and then stamping the plastic encased metallic strip into a plurality of connectors.

6. The improvement of claim 5 wherein the plurality of connectors are attached to one another, and then individually severed from one another.

* * * * *